US005228264A

United States Patent [19]

Whitman

[11] Patent Number: 5,228,264

[45] Date of Patent: Jul. 20, 1993

[54] METHOD OF AFFIXING RUBBER ROOFING SHEETS TO THE UPPER SURFACE OF A ROOF

[76] Inventor: Robert E. Whitman, 2465 Knights Hill, Toledo, Ohio 43614

[21] Appl. No.: 792,171

[22] Filed: Nov. 14, 1991

[51] Int. Cl.[5] ..... E04B 1/00

[52] U.S. Cl. ..... 52/741.1; 52/464; 52/746; 52/410; 156/71

[58] Field of Search ..... 52/741, 464, 746, 410; 156/71

[56] References Cited

U.S. PATENT DOCUMENTS

| | | | |
|---|---|---|---|
| 2,019,095 | 10/1935 | Robinson | 52/741 |
| 4,546,589 | 10/1985 | Seaman | 52/748 X |
| 4,619,100 | 10/1986 | Emblin | 52/748 |
| 4,688,361 | 8/1987 | Kelly | 52/410 X |
| 4,747,241 | 5/1988 | Whitman | 52/410 X |
| 4,751,802 | 6/1988 | Whitman | 52/410 X |
| 4,787,188 | 11/1988 | Murphy | 52/746 X |
| 4,793,116 | 12/1988 | Whitman | 52/410 X |
| 4,860,514 | 8/1989 | Kelly | 52/746 X |
| 4,996,803 | 3/1991 | Karrfalt | 52/746 X |
| 5,035,028 | 7/1991 | Lemke | 52/748 X |

*Primary Examiner*—Richard E. Chilcot, Jr.
*Assistant Examiner*—Beth A. Aubrey
*Attorney, Agent, or Firm*—George R. Royer

[57] ABSTRACT

The subject process is directed to a method of attaching rectangularly shaped sheets of rubber roofing material to the upper surface of a roof and comprises affixing a plurality of rubber roof sheets, in a regular pattern, over the upper surface of a roof structure, and affixing over the rubber roof sheets in a grid-like matrix, plates on portions of the perimeter of the rubber roof sheets, fastening adjacent the perimeter edges of such sheets, in a matrix-like manner. In such matrix pattern, plates are spaced from one another in an even manner. The subsequent steps involve affixing the holding plates to seal the plates against the rubber roof sheaths.

1 Claim, 1 Drawing Sheet

METHOD OF AFFIXING RUBBER ROOFING SHEETS TO THE UPPER SURFACE OF A ROOF

BACKGROUND OF INVENTION AND DESCRIPTION OF PRIOR ART

The subject invention relates to a method of affixing rectangularly shaped rubber roof sheets to the upper surface of a roof. Rubber roofing sheets have become desirable as a method of covering roofs of commercial buildings and in this respect the conventional approach is to utilize a grid-like pattern of fastening plates, usually square-shaped members, dispersed and spaced relative to one another in a regular pattern, generally four feet or more apart. Thus, the prominent arrangement for use of the fastening plates is a series of rows and columns, regularly and symmetrically spaced, as viewed downward to the upper surface of the roof.

In the existing art, the usual practice is to space the fastening or holding plates so that the perimeter plates are approximately four feet or more from the edge of the roof. Once the plates are in place, they serve as the medium to which the rubber sheath is glued to affix same to the roof. Moreover, in many instances, rubber roof sheets are placed over the entire roof so as to cover the entire roof surface. In the conventional method of affixing rubber roof sheets to the roof deck, bonding plates with downwardly thrusting nails or screws are affixed to the upper surface of a particular rubber roof sheet. In this latter arrangement, the bonding plates are generally placed in the center or middle areas of the rubber roof sheets to fasten same to the upper surface of a roof deck. This leaves edges of the rubber roof sheet exposed with a tendency to curl upwardly by reason of wind and water damage.

More specifically, one of the problems with the presently used process of spacing the fastening plates inwardly from the sheet edge is that during high winds, the edge of the rubber sheath is easily blown upward from the edges so as to cause the whole sheet, or edge of the roof to lift off, thus exposing the basic roof structure to potential water damage, further wind damage, and encroachment by other elements, including rodents, and so forth. The attendant problems are obvious and serious.

The subject invention is conceived to overcome these problems and the following objects of the subject invention are directed accordingly.

OBJECTS OF THE INVENTION

In view of the above, it is an object of the subject invention to provide an improved method for affixing rubber roofing sheets to the upper surface of a roof;

Another object of the subject invention is to provide a novel process for integrating rubber roofing sheaths to the upper surface of a roof;

A further object of the subject invention is to provide an improved method for covering roof structures;

Other and further objects will become apparent from a reading of the following description taken in conjunction with the claims.

DESCRIPTION OF GENERAL EMBODIMENT

Figure 1:
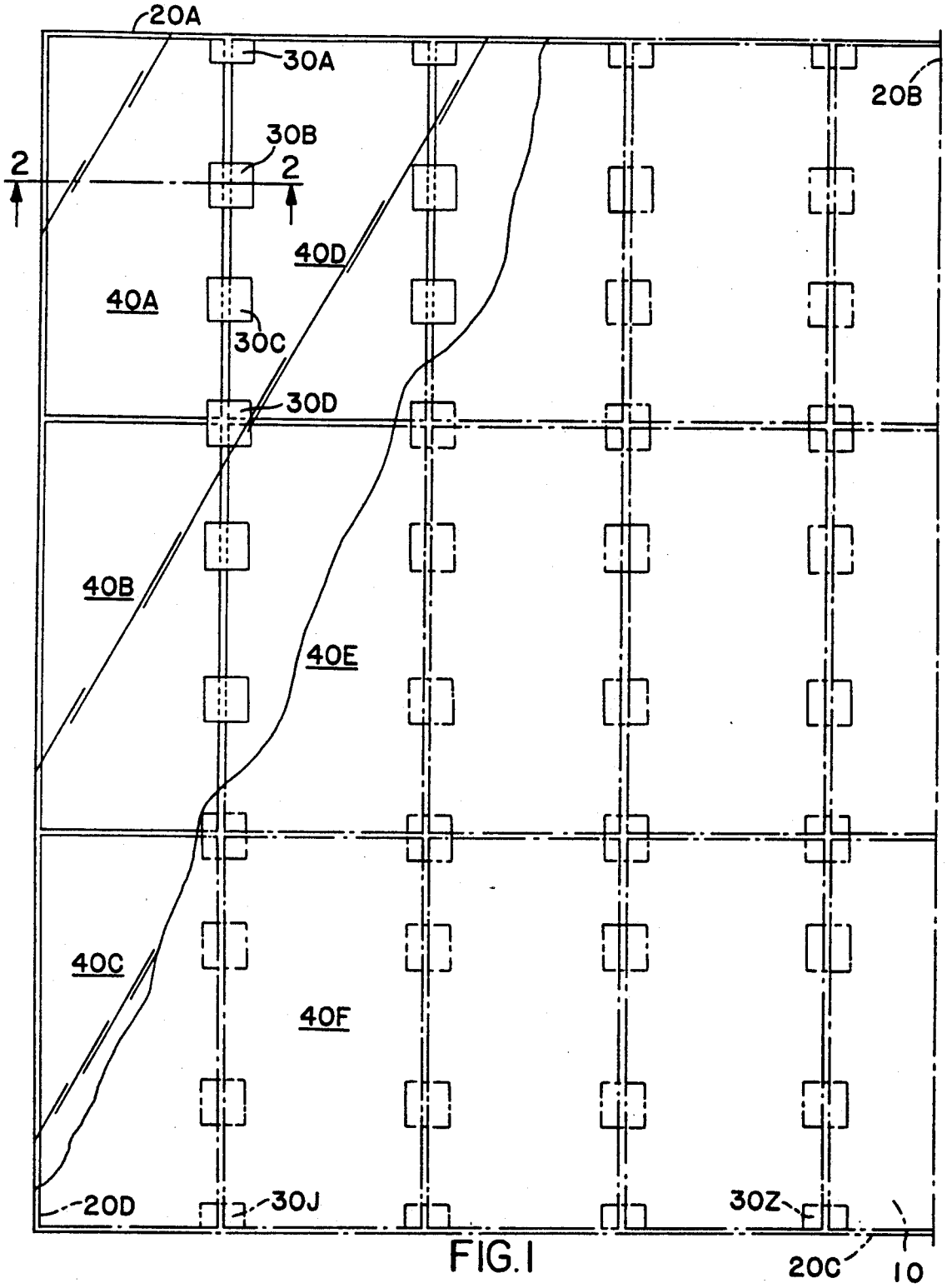
FIG. 1 is a top planar view of a roofing structure and apparatus incorporating features of the subject invention.
Figure 2:
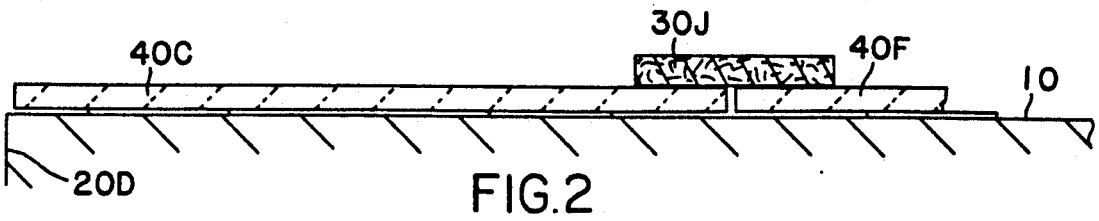
FIG. 2 is a side elevational view of the subject roofing apparatus.

The subject invention comprises a series of steps utilized to fasten plurality of roofing sheets, in a flush manner, against the upper surface of a roof. The first step in this process is to clear the upper roof surface of all foreign materials including grease and physical objects. The next step involves the attachment of rubber roof sheets to the upper deck. Thereafter bonding plates are affixed to the upper surface of the rubber roof sheets. These bonding plates are attached to the upper surface of the sheets in a grid-like pattern whereby the bonding plates are aligned in a regular and symmetrical fashion along a series of rows and columns, as viewing the fasteners from a top planar view. In the general embodiment of the subject invention, these bonding plates are spaced and affixed on the edges of the rubber roof sheets so that the center of each bonding plate is affixed through the seam formed by two adjoining rubber roof sheets.

DESCRIPTION OF PREFERRED EMBODIMENT

The subject invention is a process of affixing rubber roof sheets to the upper surface of a roof of any type of structure. However, the preferred embodiment of the subject invention is most applicable to roof structures wherein the roof is horizontal. Moreover, description and application of the preferred embodiment is not to be considered as limiting the scope of the subject invention.

The subject invention involves affixing rubber roof sheets to an upper roof surface 10. In this respect the roof is usually a horizontal, flat roof having perimeter edges 20A, 20B, 20C and 20D of any regular or 14A irregular geometric configuration.

The first step in the process is to affix a plurality of rubber roof sheets 40A, 40B . . . 40F to the upper surface of a roof in an adjoining 17A manner. In the preferred arrangement the rubber roof sheets 40A, 40B . . . 40F are 18A placed adjacent to one another so as to create a common seam along adjoining edges, where they adjoin one another.

The next step is to affix bonding plates 30A, 30B . . . 30Z 23A can be in a regular grid-like pattern with planar symmetry or in an irregular grid pattern over top of the rubber roof sheets. Specifically, each bonding plate can be affixed to the rubber roof sheet 40, 40B . . . 40F in a series of evenly 24A-spaced rows and columns, as viewed from an upper elevational view. It is not critical to the subject invention that the bonding plates be affixed in a regular pattern, however, as seen in the preferred embodiment, each bonding plate is affixed along and over a seam formed between adjoining rubber rubber sheets 40A, 40B . . . 40F. More specifically, in the preferred embodiment, each bonding plate 30A, 30B . . . 30Z is placed over a corner or edge seam between adjoining sheets so as to help anchor down adjoining sheets. This feature permits each bonding plate 30A, 30B . . . 30Z along seams to help secure two sheets, while bonding plates at corner seams to help secure four adjoining rubber roof sheets.

In summary, the subject invention comprises the following steps:

(a) placing rubber sheets in a planar and flush manner evenly in an adjoining manner so as to create longitudinal seams and corner seams between adjoining rubber roof sheet members;

(b) placing securing means in the form of bonding plates at least at one point along the longitudinal seam between adjoining rubber roof sheet members, to secure against adjacent portions of adjacent sheets;

(c) placing securing means in the form of bonding plates at each of the corner seams.

I claim:

1. A method of affixing rubber roof sheets to the upper surface of a roof deck comprising the following steps:

(a) placing rubber sheets in a planar and flush manner evenly in an adjoining manner so as to create longitudinal seams and corner seams between adjoining rubber roof sheet members;

(b) placing securing means in the form of bonding plates at least at one point along the longitudinal seam between adjoining rubber roof sheet members, to secure against adjacent portions of adjacent sheets;

(c) placing securing means in the form of bonding plates at each of the corner seams.

* * * * *